US010507463B2

(12) United States Patent
Wilth et al.

(10) Patent No.: US 10,507,463 B2
(45) Date of Patent: Dec. 17, 2019

(54) PIPETTE FOR ACTIVATING A SYRINGE

(71) Applicant: Eppendorf AG, Hamburg (DE)

(72) Inventors: Marc Wilth, Hamburg (DE); Burkhardt Reichmuth, Hamburg (DE); Jörg Sattler, Hamburg (DE)

(73) Assignee: Eppendorf AG, Hamburg (DE)

( * ) Notice: Subject to any disclaimer, the term of this patent is extended or adjusted under 35 U.S.C. 154(b) by 424 days.

(21) Appl. No.: 15/322,552

(22) PCT Filed: Jun. 23, 2015

(86) PCT No.: PCT/EP2015/064076
§ 371 (c)(1),
(2) Date: Dec. 28, 2016

(87) PCT Pub. No.: WO2016/001010
PCT Pub. Date: Jan. 7, 2016

(65) Prior Publication Data

US 2017/0151556 A1 Jun. 1, 2017

(30) Foreign Application Priority Data

Jul. 4, 2014 (DE) ..... 10 2014 109 345

(51) Int. Cl.
*B01L 3/02* (2006.01)

(52) U.S. Cl.
CPC ..... *B01L 3/0234* (2013.01); *B01L 2200/025* (2013.01); *B01L 2200/12* (2013.01)

(58) Field of Classification Search
None
See application file for complete search history.

(56) References Cited

U.S. PATENT DOCUMENTS 4,335,621 A * 6/1982 Tervamaki ..... B01L 3/0234 222/391
4,406,170 A * 9/1983 Kuhn ..... G01F 11/06 73/864.16
4,415,101 A * 11/1983 Shapiro ..... B01L 3/0234 222/288
4,498,904 A * 2/1985 Turner ..... A61M 5/24 422/928
5,591,408 A * 1/1997 Belgardt ..... B01L 3/0234 222/287
5,620,660 A * 4/1997 Belgardt ..... B01L 3/0279 403/368

(Continued)

FOREIGN PATENT DOCUMENTS

CN 1248495 A 3/2000
CN 1248734 A 3/2000

(Continued)

*Primary Examiner* — Jill A Warden
*Assistant Examiner* — Brittany I Fisher
(74) *Attorney, Agent, or Firm* — Vidas, Arrett & Steinkraus, P.A.

(57) ABSTRACT

A pipette for actuating a syringe including a strip-shaped housing with first and second receptacles for inserting fastening sections. First and second releasable holding mechanism for holding the fastening sections. First and second displacing mechanisms to displace a receiving body in the housing from the receptacles. A toothed rack and a pawl are connected to an actuation rack. A cover has a coupling element and longitudinal slot and spring.

17 Claims, 13 Drawing Sheets

(56) References Cited

U.S. PATENT DOCUMENTS

| | | | | |
|---|---|---|---|---|
| 5,620,661 | A | 4/1997 | Schurbrock | |
| 5,879,633 | A * | 3/1999 | Tervamaki | B01L 3/0234 422/516 |
| 7,731,908 | B2 | 6/2010 | Lenz | |
| 8,408,079 | B2 * | 4/2013 | Reichmuth | B01L 3/0279 73/864.16 |
| 9,289,762 | B2 | 3/2016 | Belgardt et al. | |
| 2009/0139351 | A1 | 6/2009 | Reichmuth et al. | |
| 2013/0319139 | A1 * | 12/2013 | Belgardt | B01L 3/021 73/864.13 |
| 2014/0010731 | A1 * | 1/2014 | Belgardt | B01L 3/0234 422/501 |
| 2014/0010732 | A1 * | 1/2014 | Belgardt | B01L 3/0217 422/501 |

FOREIGN PATENT DOCUMENTS

| | | | |
|---|---|---|---|
| CN | 103249487 | A | 8/2013 |
| CN | 103285952 | A | 9/2013 |
| CN | 103298560 | A | 9/2013 |
| CN | 103372472 | A | 10/2013 |
| CN | 103447104 | A | 12/2013 |
| CN | 103506173 | A | 1/2014 |
| DE | 2365947 | A1 | 12/1976 |
| DE | 29 26 691 | C2 | 5/1983 |
| DE | 44 37 716 | C2 | 10/1996 |
| DE | 20 2010 010 942 | U1 | 11/2011 |
| DE | 10 2012 102 292 | A1 | 8/2013 |
| DE | 10 2012 011 938 | A1 | 12/2013 |
| EP | 0 656 229 | B1 | 7/1997 |
| EP | 0 679 439 | B1 | 3/1998 |
| EP | 0 657 216 | B1 | 5/1999 |
| EP | 1557222 | A2 | 7/2005 |
| EP | 2 033 712 | A1 | 3/2009 |
| EP | 1 724 020 | B1 | 3/2010 |
| EP | 2 633 915 | A2 | 9/2013 |
| EP | 2 656 916 | A1 | 10/2013 |
| EP | 2 676 730 | A1 | 12/2013 |
| WO | 84/04056 | A1 | 10/1984 |

* cited by examiner

PIPETTE FOR ACTIVATING A SYRINGE

FIELD OF THE INVENTION

The invention relates to a pipette for actuating a syringe.

BACKGROUND OF INVENTION

The pipettes at issue here for actuating a syringe serve to dispense the liquid drawn into the syringe in several steps. They are also termed dispensers or repeating pipettes. At the bottom end of a rod-shaped housing, these pipettes have a receptacle for a flange of a syringe cylinder and, in the housing, have a displaceably receiving body with a plunger receptacle for the top end region of a plunger rod of a syringe plunger. The syringe can be inserted with the flange and the end region of the plunger rod through axially-aligned openings in the receptacles. The flange and the end region are held in the receptacles by means for releasably holding that, for example, are designed as spring-loaded grip levers. Furthermore, the pipette has means for displacing the receiving body that make it possible to partially remove the plunger from the cylinder to draw liquid into the syringe, and press the plunger stepwise into the cylinder for the stepwise dispensing of liquid.

DE 29 26 691 C2 and U.S. Pat. No. 4,406,170 describe means for displacing the receiving body in the housing. These comprise a drawing lever that is connected to the receiving body and projects out of the housing through a straight slot for drawing liquid into the syringe by moving the receiving body away from the receptacle. Furthermore, it comprises a toothed rack and pawl apparatus for moving the plunger in steps by a metering lever that can be moved back and forth. A pivotable pawl is mounted on the metering lever. The toothed rack is connected to the receiving body and is arranged within the pivot range of the pawl. An adjustably movable cover more or less covers the row of teeth on the toothed rack to limit the engagement of the pawl in the toothed rack when pivoting the metering lever. The movable cover can be displaced by means of a knob arranged on the pipette housing. The knob is equipped with an eccentric guide curve in which a guide pin of the movable cover engages. Furthermore, the toothed rack is designed with an upwardly extending projection, and the cover has a downwardly sloping rest that engages with the projection when the plunger is far forward, which allows the cover to be moved away from the toothed rack so that it prevents the pawl from engaging in uncovered teeth of the toothed rack. This remaining travel block prevents a residual amount from being dispensed from the syringe that is less than the metered quantity (dispensing volume) to be dispensed in each metering step.

The Multipette® manual pipette by Eppendorf AG is designed according to the above patent.

Developments of the means for releasably holding the syringe are described in EP 0 656 229 B1 and U.S. Pat. No. 5,620,660. EP 1 724 020 B1 and U.S. Pat. No. 7,731,908 B2 describe a development of the holding apparatuses that make it possible to release the syringe from the pipette by single-hand actuation.

EP 0 657 216 B1 and U.S. Pat. No. 5,620,661 describe such a pipette with a sensor for sensing elevations and recesses on the syringe flange of the syringes, and correspondingly designed syringes. The sensor serves to determine the size of the inserted syringe. Electronics determine the amount of the liquid dispensed in each dispensing step based on the set increment. This is shown on a display.

Developments of the means for displacing the receiving body are described in DE 44 37 716 C2, EP 0 679 439 B1 and U.S. Pat. No. 5,591,408. According to EP 0 679 439 B1 and U.S. Pat. No. 5,591,408, a repeating pipette has a constant increment apparatus that sets a constant value for the length of the first step for moving the receiving body for the actuating section of the syringe plunger toward the cylinder receptacle for the syringe cylinder, the value being independent of the setting of the following increments. Play between the pipette and syringe which impairs the metering precision is overcome by means of this constant reverse travel when the receiving body is moved back toward the cylinder receptacle after drawing liquid.

In the Multipette® Plus manual pipette by Eppendorf AG, the cover has an elongated sleeve made of plastic in which a threaded rod is movably arranged. A metal sleeve is glued in the bottom end of the plastic sleeve. The metal sleeve projects from the bottom end of the plastic sleeve and has a catching edge at the bottom below which the thread is exposed for engaging the pawl. In a metering step, the pawl first slides over the metal sleeve that keeps the pawl from engaging in the thread of the threaded rod. Once the pawl passes the catching edge in the metering step, it drops into the thread. For this purpose, the pawl is pressed by means of a spring against the metal sleeve and thread. Due to production tolerances, the pawl may not drop precisely into the base of the thread under the catching edge but rather on a flank or a peak of the thread. When the pawl contacts a flank or the peak of the thread that is arranged above the thread base, the metering lever must be swung further downward slightly until the pawl engages in the thread base and advances the threaded rod and hence the syringe plunger. This causes a metering error because insufficient liquid is dispensed. When the pawl contacts a flank or the peak of the thread which is arranged below the thread base, an insufficient amount of the pivoting movement of the metering lever is used for displacing the threaded rod and hence the plunger. In this case as well, insufficient liquid is dispensed. It can even happen that the pawl slides off the flank or peak of the thread and drops down further into the thread base, or slides several times across the thread which produces a greater metering error, or no liquid is dispensed. The metering error can be overcome by adjusting the threaded rod. For this purpose, the threaded rod is screwed into an adjustment thread in the receiving body for the top end of the plunger rod and provided with a cross hole. By means of a pin inserted in the cross hole, the threaded rod can be screwed into a different axial position relative to the receiving body. This changes the position of the threaded rod when the pawl drops. This adjustment of the assembled pipette is involved. If the metal sleeve is glued too deeply in the plastic sleeve, too much liquid is dispensed, and the displayed number of metering steps cannot be reached. This error must be overcome by exchanging the cover.

With the Multipette®Plus, a metal strip is affixed to the sleeve made of plastic and has a projecting bend in an elastically extendable section, and a leaf spring running parallel to the toothed rack. The metal strip is held on plastic domes, the ends of which are melted on and shaped by ultrasound. At the end, the toothed rack has a cam, the position of which is adjustable in the axial direction of the toothed rack. At the end of the advancing movement of the plunger, the cam contacts the bend which causes the elastically extendable region of the metal strip to be deflected, and the pawl is prevented from engaging further in the toothed rack. This produces the remaining travel block. The cam must be adjusted after the threaded rod is adjusted so that the remaining travel block takes effect precisely when there is an insufficient metered quantity. The production of the cover and the adjustments are involved. In addition, all of the adjustments must be redone when components of the plunger drive are exchanged.

DE 10 2012 011 938 A1 describes a pipette in which the cover has a first cover part made of plastic on which the guide pin is formed. Arranged on the first cover part is a second cover part in the form of a metal strip on which the catching edge is formed and that has the bend and leaf spring of the remaining travel block. The relative position of the first and second cover part to each other in the longitudinal direction of the toothed rack can be adjusted by means of a cam apparatus of the cover. The distance between the catching edge and guide pin can be precisely adjusted therewith to ensure that the pawl drops precisely into the toothed rack despite production tolerances, wear or repair. In adjusting the catching edge, the remaining travel block is also moved so that the remaining travel block must be subsequently adjusted as well by setting the axial position of the cam on the toothed rack. With this cover as well, the production and assembly effort is high since two adjustments always have to be made. When plunger drive components are exchanged, the adjustments need to be repeated. An additional disadvantage is that the cam on the toothed rack is first guided on a smooth inner surface of the cover part until it enters a longitudinal slot in the first cover part upon contacting the bend. When the cam passes into the longitudinal slot, a small lateral movement of the toothed rack may occur that prevents the pawl from correctly dropping into the toothed rack if the adjustments were not performed with sufficient precision.

With the Handy-Step-S manual pipette by Brand, the liquid volume to be metered in each step is also adjusted with a knob. Furthermore, the engagement of the pawl in the toothed rack can be adjusted with the knob. For this purpose, the knob has two knob parts whose angular position relative to each other can be adjusted by a gearing. One knob part has markings for adjusting the metering volume. The other knob part has the guide curve in which the pin engages that projects from the cover. By turning the knob, the cover is displaced along the toothed rack. By adjusting the angular position of the two knob parts, the position of the catching edge can be adjusted so that the pawl drops into the trough of a tooth. With this pipette, the high structural complexity and required complexity in adjusting the assembled pipette is disadvantageous.

The above pipette is basically described in DE 20 2010 010 942 U1.

Against this background, an object of the invention is to create a pipette in which a dropping of the pawl into the toothed rack can be optimized with reduced complexity in production and assembly.

SUMMARY OF THE INVENTION

The pipette according to the invention for actuating a syringe has:

- a rod-shaped housing,
- a first receptacle with a first opening at the bottom end of the housing for inserting a first fastening section at the top edge of a cylinder of the syringe,
- a receiving body with a second receptacle and a second opening at the bottom end in the housing for inserting a second fastening section on a plunger of the syringe,
- first means for releasably holding the first fastening section in the first receptacle,
- second means for releasably holding the second fastening section in the second receptacle,
- first means for displacing the receiving body in the housing away from the receptacle,
- second means for displacing the receiving body toward the first receptacle in steps by an increment corresponding to the liquid volume to be ejected by the syringe in the steps,
- an actuation element which can be actuated outside of the housing for executing individual steps,
- a toothed rack with teeth arranged in the housing and connected to the receiving body,
- a pawl pivotably mounted in the housing on the actuation element which engages with the teeth of the toothed rack and entrains the toothed rack when the actuation element is displaced downward, and disengages with the teeth when the actuation element is displaced upward,
- an adjusting element for adjusting the increment of the steps that can be adjusted outside of the housing,
- a cover displaceably arranged on the toothed rack on the side of the pawl with a holding surface facing the pawl, for holding the pawl from engaging in the teeth, and a catching edge at the bottom end, below which the teeth are exposed for engagement by the pawl,
- a coupling element arranged on the cover that is coupled to the adjusting element to transfer an adjustment of the adjusting element to the cover,
- wherein the cover has a first cover part consisting of plastic that comprises the coupling element and a longitudinal slot, and a second cover part, consisting of sheet metal held on the first cover part, that comprises a bend arranged in the longitudinal slot and an associated leaf spring,
- the catching edge is formed on the first cover part,
- the toothed rack on the side facing the cover has a projecting cam that contacts the bend in the longitudinal slot at the end of the displacement of the receiving body toward the receptacle, whereby the leaf spring is deflected, and the pawl is held by the leaf spring from further engagement in the teeth of the toothed rack, and
- with the exception of a section comprising at least the bend and leaf spring, the second cover part is overmolded by the plastic of the first cover part in a specific position of the bend with respect to the coupling element which securely connects the first cover part and second cover part to each other.

As with the previous pipettes, it was assumed that two adjustments are required for optimum dropping of the pawl in the teeth of the toothed rack and effectuating the remaining travel block when the actuation element is actuated in which a complete metering step is no longer possible. The invention is based on the awareness that for the pawl to optimally drop and the remaining travel block to be correctly triggered, it is crucial to maintain specific distances between the coupling element and catching edge, and between the catching edge and bend, and to precisely position the cam relative to the teeth of the toothed rack. Furthermore, the invention is based on the awareness that the previously-used production methods (sheet metal processing and injection molding) and joining methods (gluing, shaping retaining domes and screwing) do not enable sufficient production tolerances for this purpose. With the invention, it was surprisingly found that by partially over-molding the second cover part with the plastic of the first cover part when the bend is in a specific position, sufficiently precise distances between the coupling element and catching edge, and catching edge and bend, can be achieved. When overmolding the second cover part, the entire first cover part and hence the coupling element as well as the catching edge are injection molded. The first and second cover part are securely connected to each other by overmolding. The coupling element, catching edge and bend have specific distances relative to each other due to the high precision of the injection molding procedure and the precise position of the bend during injection molding. A sufficiently dimensionally accurate cover is achieved by the combination of injection molding and the precise position of the bend. Tolerances in the production of the second cover part do not impair the dimensional accuracy of the cover because the bend assumes a specific position during injection molding, and the coupling element and catching edge are created at specific distances from the bend.

During the production of the cover, first the second cover is inserted into an injection mold, wherein the bend abuts a contact surface of the injection molding procedure and then, when the mold is closed, it is partially overmolded with the plastic of the first cover part. The toothed rack is preferably injection molded as a single part with the cam made of plastic. Alternatively, the toothed rack is provided with an adjustable cam in order to compensate for remaining imprecisions.

With the pipette according to the invention, the complexity of production and assembly is reduced, and the desired position of metering and remaining travel block is nonetheless ensured. Later readjustments have proven to be entirely unnecessary, and the lack of adjustment options is, therefore, not a disadvantage. Even when components of the plunger drive are exchanged, readjustment is unnecessary since equally precise components can be obtained.

According to one embodiment of the pipette, a head section of the second cover part is overmolded by the plastic of the first cover part adjacent to a top slot section of the longitudinal slot on the side facing the toothed rack on the edge, and the head section is connected at the bottom end to the bend that is arranged in a bottom slot section of longitudinal slot, next to which the second cover part is not overmolded with the plastic of the first cover part, so that the cam in the longitudinal slot can slide along the head section before it contacts the bend. This embodiment prevents a lateral deflection of the cam upon entering the slot and prevents metering errors caused thereby.

According to another embodiment, the second cover part has a first strip-shaped section that is connected to the bottom end of the head section that is connected to the bend at the bottom end, and is arranged in the bottom slot section. The first strip-shaped section forms a flexible spring that makes it easier for the bend to be deflected by the cam.

According to another embodiment, the second cover part has a third strip-shaped section connected to the bottom end of the bend that is arranged in the bottom slot section, and on which the cam can slide after passing the bend. This makes it easier for the cam to move upward past the bend.

According to another embodiment, a connecting section is connected to a longitudinal side edge of the first or second strip-shaped section, extends through a recess in the top side of the first cover part to the longitudinal side edge of the first cover part, and is connected to the downwardly extending leaf spring across a deflection parallel to the longitudinal side of the first cover part. This is advantageous for production and promotes a wide deflection of the leaf spring.

According to a preferred embodiment, the second cover part is elastic.

According to another embodiment, the second cover part is produced as a single part from sheet metal, i.e., from a flat, thin-wall metal plate. The maximum wall thickness of the sheet metal is 0.5 mm and preferably 0.4 mm. To produce the second cover part, preferably one or more of the following sheet metal processing methods are used: Stamping, lasering, etching, bending, wire cut EDM, and water jet cutting.

According to a preferred embodiment, the adjusting element is a selection wheel. According to another embodiment, the guide curve is spiral.

According to one embodiment, the second cover part is covered by webs of the first cover part extending transversely to the toothed rack on the side of the first cover part facing away from the toothed rack. The webs bridge the longitudinal slot on the side facing away from the toothed rack, and hold the first cover part at the top together to save material.

According to another embodiment, a web bears the coupling element.

According to another embodiment, the coupling element is a pin that projects from the first cover part, and the adjusting element has a guide curve on the bottom side in which the pin engages so that the guide curve displaces the pin in the axial direction of the toothed rack when the adjusting element is moved.

According to a preferred embodiment, the bottom end of the first cover part has the catching edge. This makes it possible to position the catching edge very precisely relative to the coupling element.

According to another embodiment, the first cover part has a wall thickness that gradually decreases toward the bottom end. Consequently, the catching edge is at a particularly short distance from the toothed rack which helps the teeth of the pawl to always drop precisely into the teeth of the toothed rack. Given the greater wall thickness of the first cover part above the catching edge, sufficient breaking resistance can be achieved.

According to a preferred embodiment, the first cover part at the engagement edge has a maximum wall thickness of 0.5 mm and preferably 0.2 to 0.4 mm.

According to another embodiment, the first cover part on the side facing the toothed rack has a flat contact surface against which the toothed rack can rest and in which the longitudinal slot is arranged. This yields precise and low friction guidance of the toothed rack in the cover part.

According to another embodiment, the first cover part with the flat contact surface has a bevel toward the bottom end on the side facing away from the toothed rack. This yields a particularly small distance between the catching edge and toothed rack.

According to another embodiment, the first cover part has the shape of an elongated hollow body with two parallel, strip-shaped side parts and a base that delimit a channel, wherein the longitudinal slot is formed in the base, and the second cover part in the base is overmolded by plastic from the first cover part. The toothed rack can be precisely guided in the channel.

According to another embodiment, the first cover part has longitudinally projecting wings on the two longitudinal sides. The wings can be used for precisely guiding the cover part in the housing.

According to a preferred embodiment, the toothed rack is injection molded from plastic as a single part with the cam.

According to another preferred embodiment, the first cover part and/or the toothed rack is produced from PEEK or another plastic with similar mechanical properties.

According to a preferred embodiment, the pawl has several pawl teeth that engage in the teeth of the toothed rack after passing the catching edge. However, the invention also relates to embodiments in which the pawl only has a single pawl tooth.

According to another embodiment, the cam is arranged on the toothed rack so as to be adjustable in an axial direction. According to another embodiment, the cam projects on the side of the spacing element through a slot in the toothed rack and has an axial hole, an adjustment screw is screwed through the hole into an adjustment thread in the top end of the toothed rack, and a spring element is arranged between the top end of the toothed rack and the cam. This design makes it possible to adjust to the axial position of the cam on the toothed rack. This influences the position of the toothed rack in which the cam contacts the second cover part, and the remaining travel block takes effect.

According to another embodiment, the first cover part is made of plastic, and/or the second cover part is made of a sheet metal. The first cover part is preferably produced by injection molding, and/or the second cover part is produced by etching, and/or stamping, and/or lasering, and/or wire cut EDM, and/or water jet cutting, and/or bending sheet metal, or other production methods.

The means for releasably holding the first fastening section in the first receptacle and the second fastening section in the second receptacle are preferably designed as described in EP 0 656 229 B1 and U.S. Pat. No. 5,620,660 or EP 1 724 120 B1 and U.S. Pat. No. 7,731,908 B2, the content of which is hereby incorporated in the present application.

The first means for displacing the receiving body in the housing are preferably designed as a drawing lever as described in DE 29 26 691 C2 and U.S. Pat. No. 4,406,170 or the documents listed in the paragraph above, the contents of which are hereby incorporated in the present application.

According to one embodiment, the pipette has a sensor for sensing elevations and recesses on the syringe flange of the syringes as described in EP 0 657 216 B1 and U.S. Pat. No. 5,620,661, the content of which is hereby incorporated in the present application.

In the present application, the term "toothed rack" addresses both a toothed rack in the actual sense, i.e., a rod with a series of teeth arranged thereupon, as well as a threaded rod, i.e., a rod with at least one thread arranged thereupon. Preferably, the pipette according to the invention is provided with a toothed rack in the actual sense.

In the present application, the designations "top" and "bottom", "high" and "low" as well as terms derived therefrom refer to the alignment of the pipette in which the rod-shaped housing is aligned vertically, and the receptacle for the syringe is arranged at the bottom.

BRIEF DESCRIPTION OF THE DRAWINGS

The invention is explained in greater detail below based on included drawings of an exemplary embodiment. In the drawings.

DETAILED DESCRIPTION OF THE INVENTION

Figure 1:
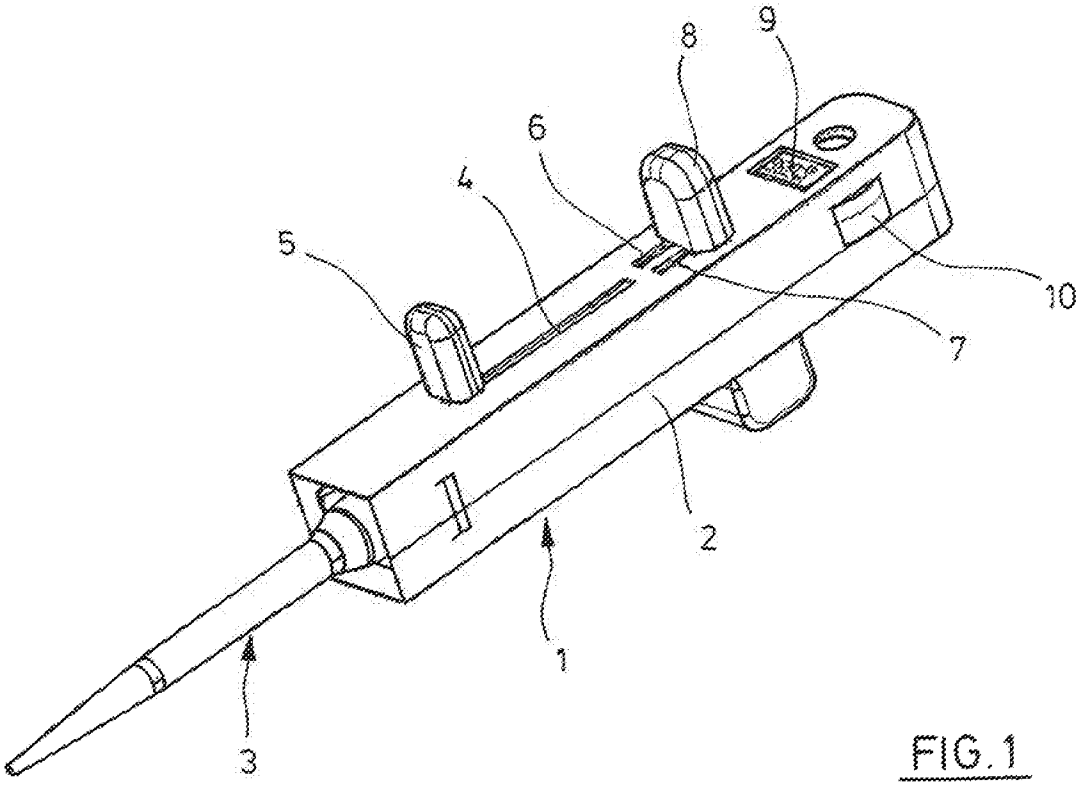
FIG. 1 shows a pipette according to the invention with a syringe held therein in a perspective view from the side.

According to FIG. 1, a pipette 1 has a rod-shaped housing 2 in which a syringe 3 is held at the bottom. A drawing lever 5 projects from the housing 2 from a sidewall of the housing 2 over a straight slot 4. A control knob 8 of a toothed rack and pawl control projects from the same side wall of the housing 2 above two additional slots 6, 7. Above that, a display apparatus in the form of a display 9 is recessed in the same side wall of the housing 2. Segments of a selection wheel 10 project from openings in the adjacent sidewall.

Figure 2:
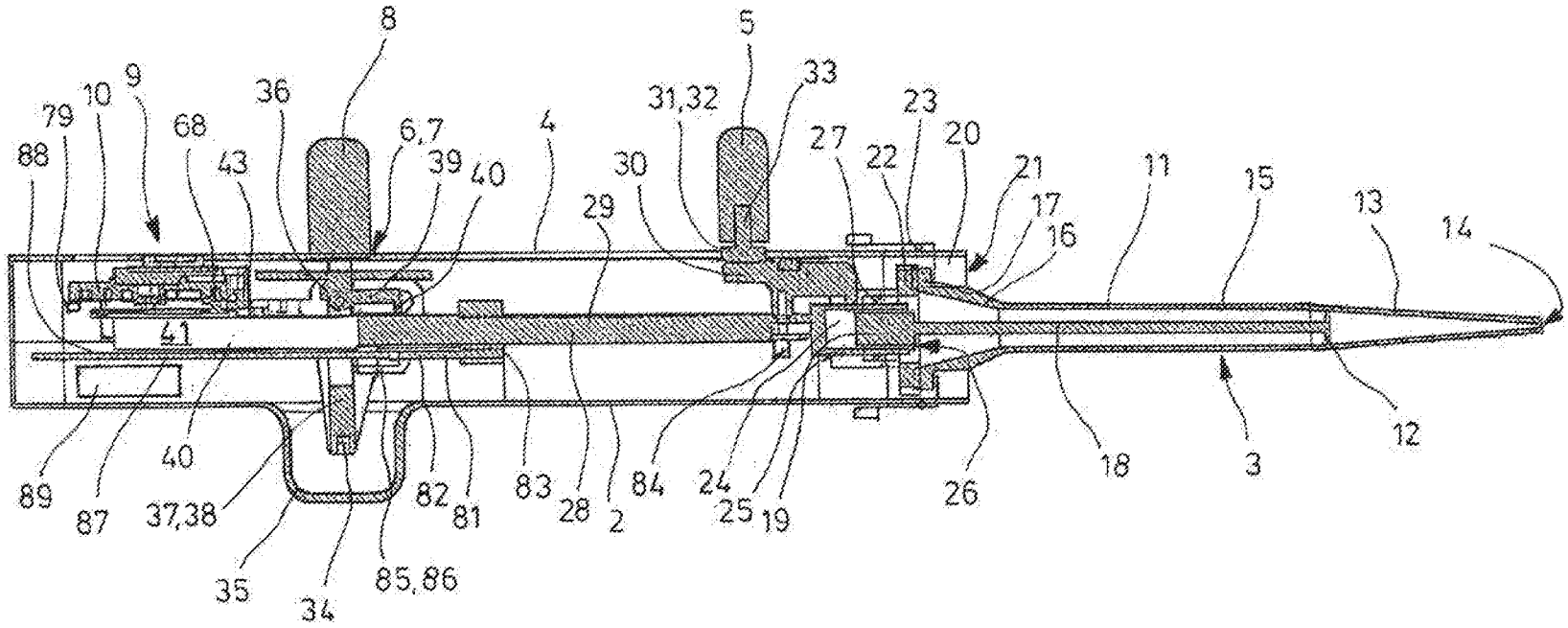
FIG. 2 shows the same pipette in a longitudinal section.
Figure 3:
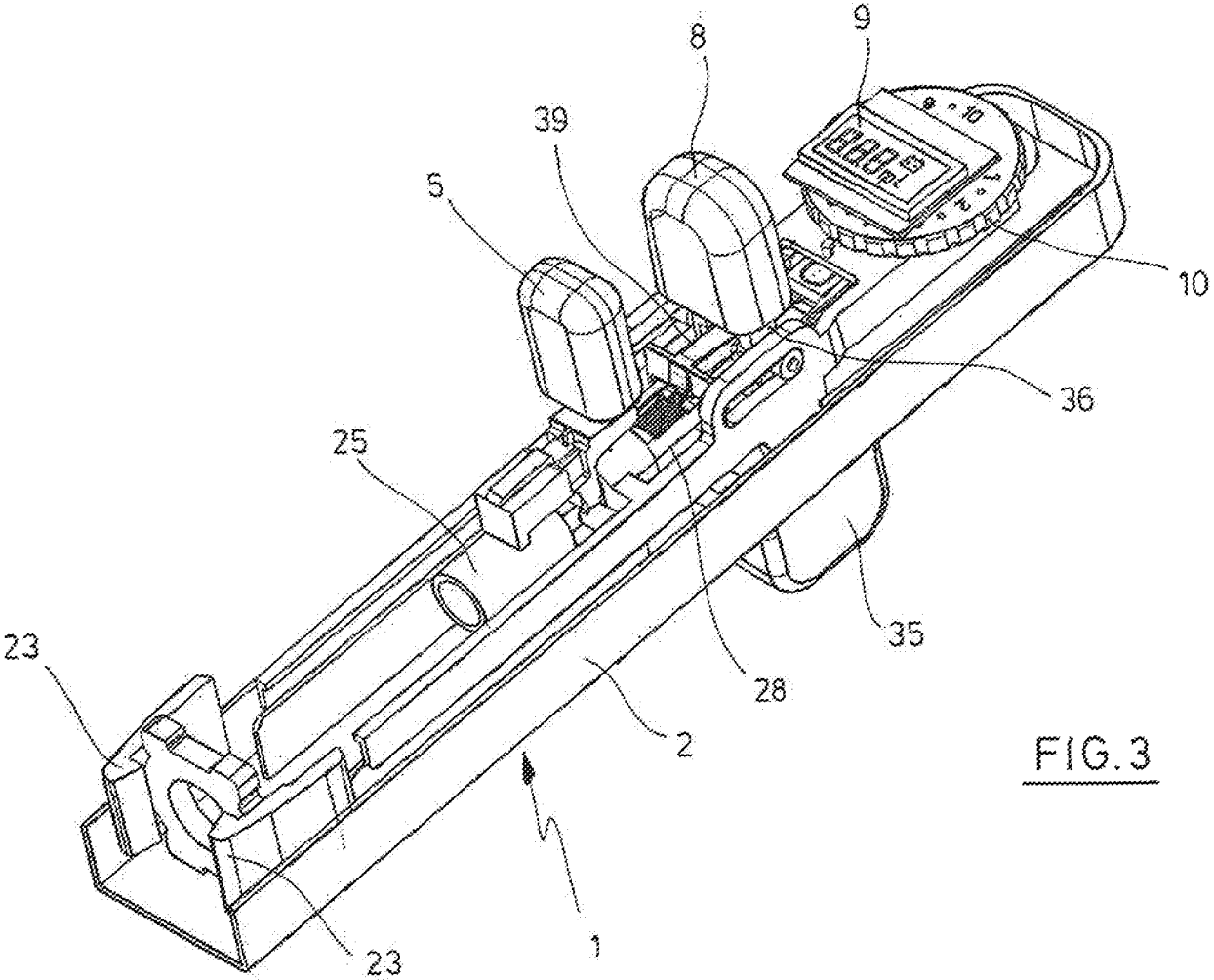
FIG. 3 shows the same pipette when the front housing half is removed in a perspective view diagonally from the front and from the side.
Figure 4:
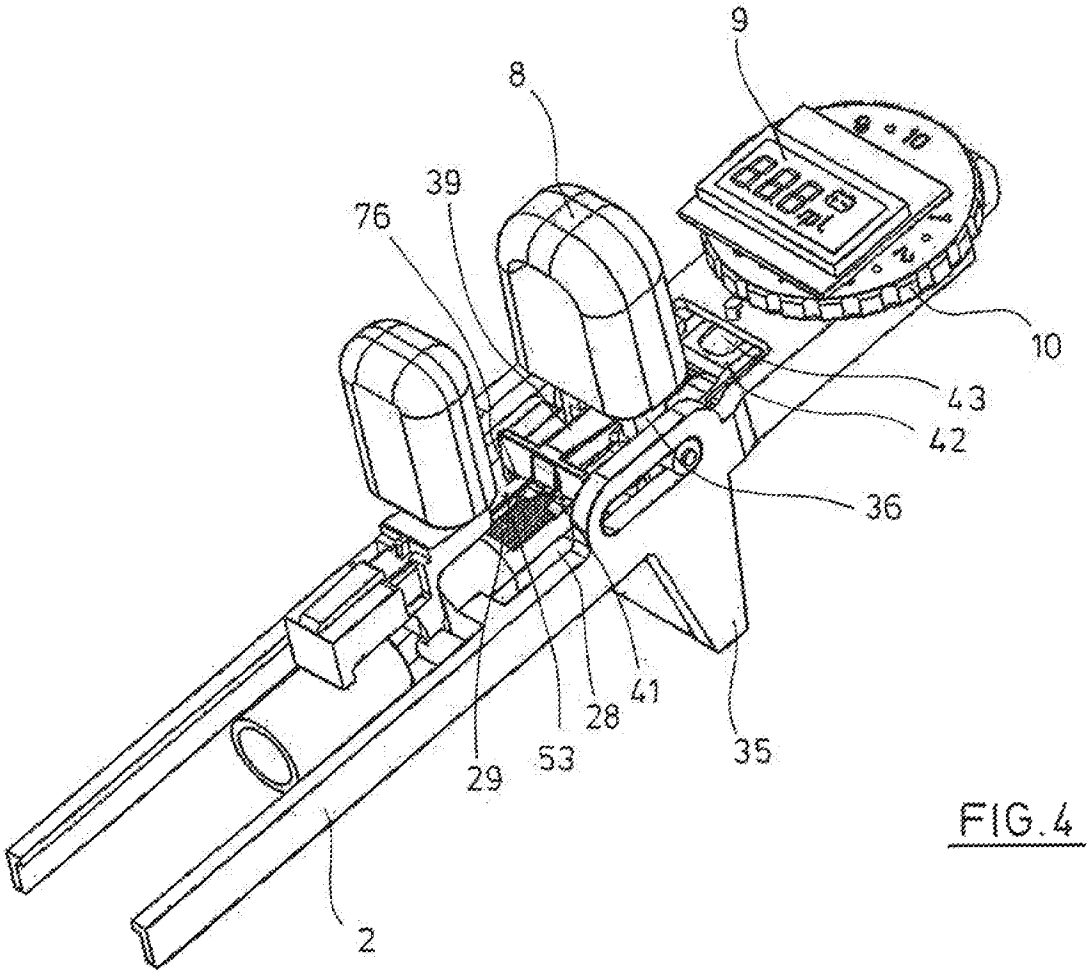
FIG. 4 shows a top frame part with components of the same pipette arranged therein when the housing is removed in an enlarged perspective view.

According to FIG. 2, the syringe 3 has a cylinder 11 and a plunger 12 movably arranged therein. The cylinder 11 has a conical section 13 at the bottom with a hole 14 for the passage of liquids, and a cylindrical section 15 above that in which the plunger 12 can be displaced. At the top, the cylinder 11 has a first fastening section 16 with a peripheral flange 17. From the plunger 12, a plunger rod 18 projects upward and has a second fastening section 19 with several peripheral beads.

The syringe 3 is arranged with the flange 17 in a first receptacle 20 on the bottom end of the housing 2 that has an axially directed first opening 21 in the bottom end of the housing 2 for inserting and removing the syringe 3. The syringe 3 presses with its top side against a pressure sensitive ring sensor 22 that senses the projections on the top edge of the flange 17. The code indicated on the flange 17 denotes the size of the respective syringe 3. The flange 17 is held in the housing 2 in this position by releasably holding first means in the form of first grip levers 23.

The second fastening section 19 of the plunger 12 is arranged in a second receptacle 24 in a hollow cylindrical receiving body 25. This has an axially directed second opening 26 for inserting the second fastening section 19. The second fastening section 19 is held by releasably holding second means in the form of second grip levers 27 that engage between the beads of the second fastening section 19 or clamp them.

The receiving body 25 is securely connected to a toothed rack 28 with teeth 29 that extend below the slot 4 in the longitudinal direction of the housing 2.

A drawing lever holder 30 is fixed to the receiving body 25 and a bottom part of the toothed rack 28.

Furthermore, there is a drawing lever support 31 with a slide plate 32 that lies against the bottom side of the edges of the slot 4. The drawing lever support 31 has a post 33 that projects upward and penetrates the slot 4. The drawing lever 5 is fixed to the post 33 outside of the housing 2.

At the end of the displacement of the receiving body 25 toward the first receptacle 20, the plate 32 contacts the bottom edge of the slot 4 which comprises a bottom stop.

In the upper half of the housing 2, an actuation element in the form of a metering lever 36 is pivotably mounted in a pivot bearing 34 in a bulge 35 in the side wall of the housing 2 opposite the slot 4. According to FIGS. 3 to 6, the metering lever 36 has two legs 37, 38 at a distance from each other that extend on the opposite side wall of the housing 2 out of the two slots 6, 7. At that location, the control knob 8 is fixed on the projecting ends of the legs 37, 38.

At the end of the displacement of the receiving body 25 upward away from the first receptacle 20, the drawing lever support 31 contacts a bearing body securely arranged in the housing 2 in which the pivot bearing 34 is formed for the metering lever 36. This comprises the top stop for the displacement of the receiving body 25.

A pawl 39 is pivotably mounted between the two legs 37, 38 of the metering lever 36. The pawl 39 is arranged with several pawl teeth 40 (three in the example) above the teeth 29 of the toothed rack 28. The metering lever 36 is pressed by a spring apparatus into the position in FIG. 2. The metering lever 36 can be swung downward by actuating the control knob 8 counter to the effect of the spring apparatus. The pawl 39 is pressed into the teeth 29 of the toothed rack 28 by means of another spring apparatus. This advances the toothed rack 28 downwards.

A movable cover 41 is arranged between the pawl 39 and toothed rack 28. The cover 41 is displaceable by turning the selection wheel 10 projecting out of the side of housing 2 so that the teeth 29 of the toothed rack 28 are more or less covered. While actuating the control knob 8, the pawl is first pressed against the cover 41 and then falls downward into the teeth 29. The extent to which the toothed rack 28 is displaced while swinging the metering lever 36 downward, therefore, depends on the position of the cover 41 relative to the teeth 29.

Figure 7:
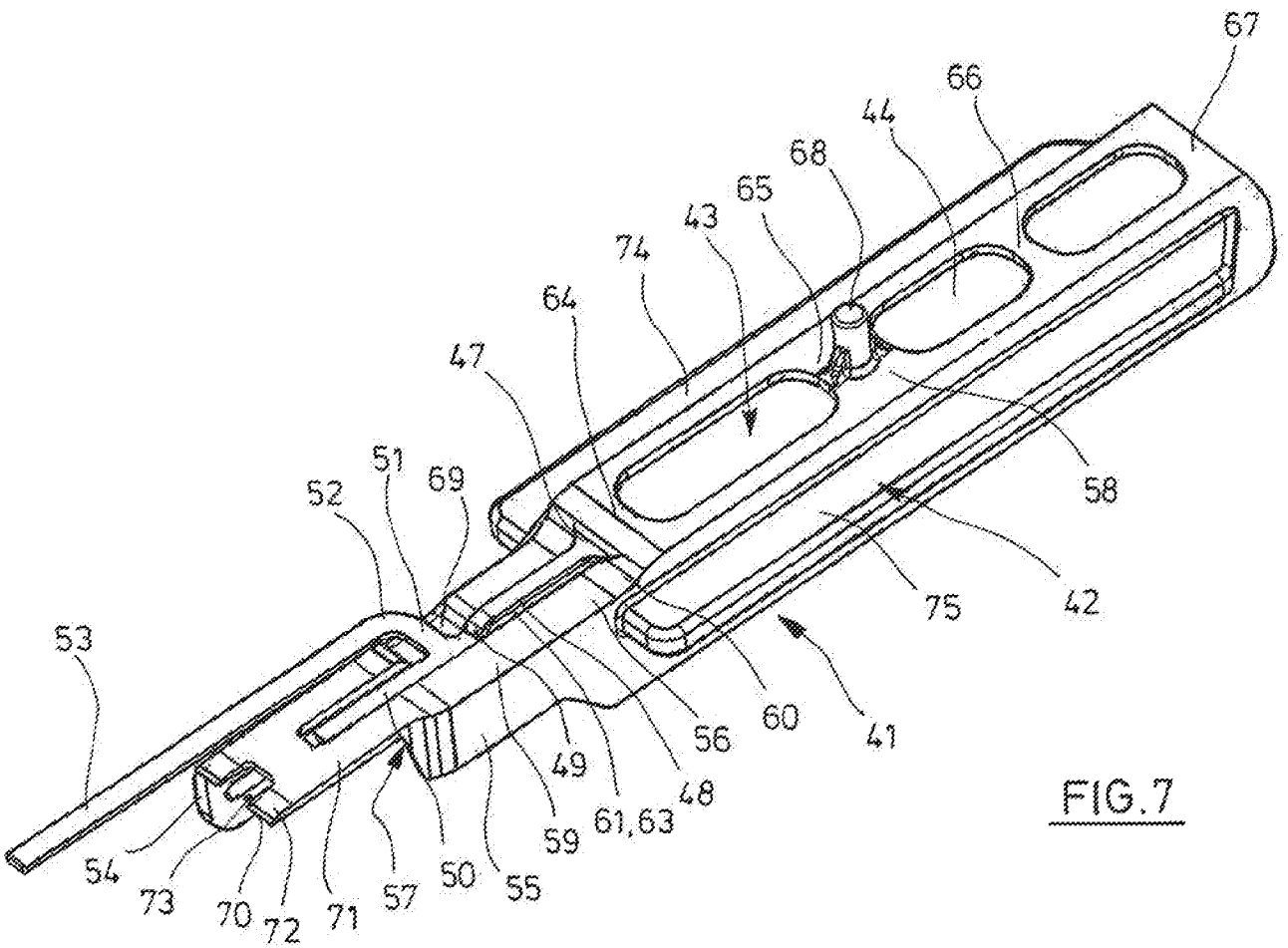
FIG. 7 shows the cover in a perspective view.

According to FIG. 7, the cover 41 consists of a first cover part 42 made of plastic and a second cover part 43 made of thin sheet metal which is partially embedded in the plastic of the first cover part 42 by being overmolded.

Figure 8:
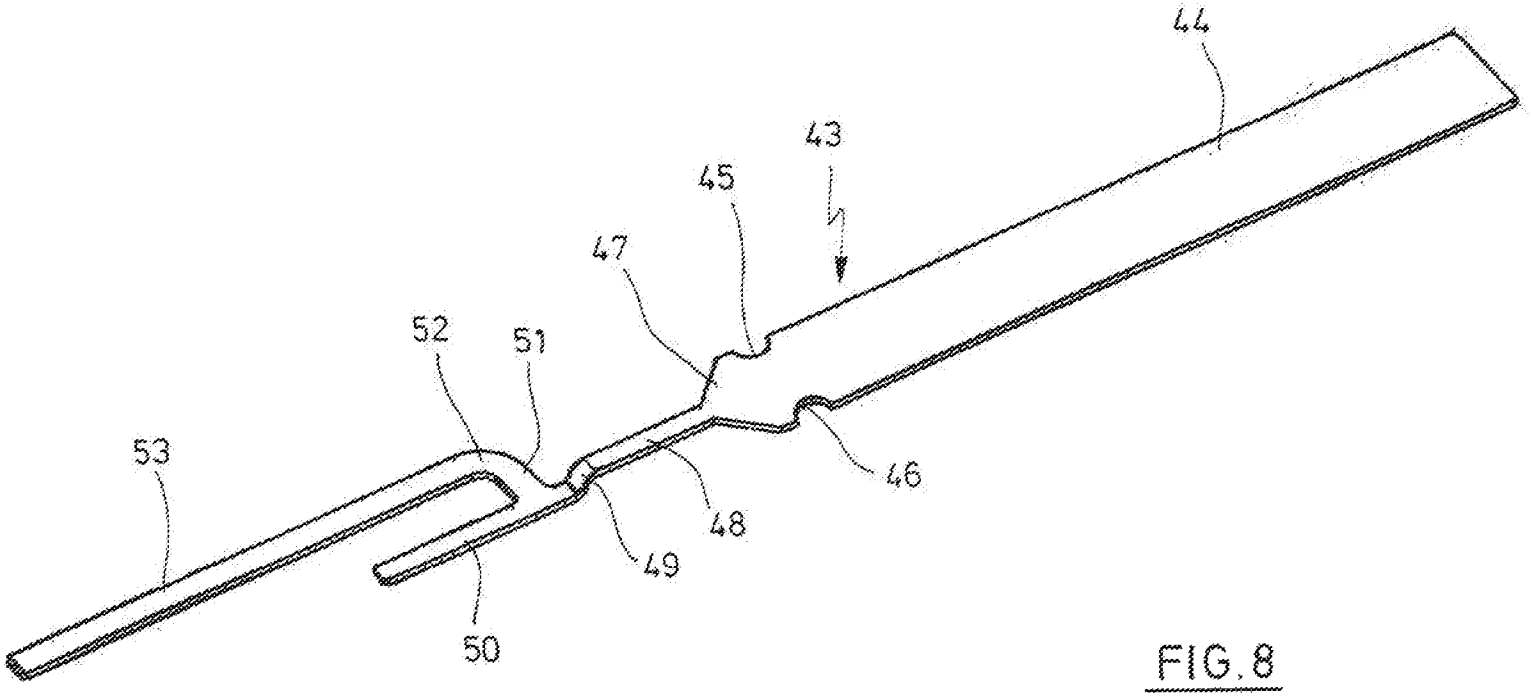
FIG. 8 shows a second cover part in an enlarged perspective view.

According to FIG. 8, the second cover part 43 has a head section 44 that has the shape of a wide strip in the example. At the bottom on the two longitudinal sides, the head section 44 has opposing notches 45, 46 that serve to anchor the first cover part 42 in the plastic. Below this, the head section 44 has a tapering 47.

The bottom end of the tapering 47 is connected to a first strip-shaped section 48. The first strip-shaped section 48 is connected by a contrary bend 49 to a second strip-shaped section 50. The head section 44, the first strip-shaped section 48 and the second strip-shaped section 50 have a common longitudinal axis.

In the top part, the second strip-shaped section 50 is connected on a longitudinal side to a strip-shaped connecting section 51 that projects perpendicular to the second strip-shaped section 50. The connecting section 51 is connected by a deflection 52 to a leaf spring 53.

The second cover part 43 is produced as a single part from a thin piece of sheet metal. The sheet metal is preferably resilient material, in particular spring steel.

According to FIG. 7, the first cover part 42 generally has the shape of an elongated hollow body with a U cross section. It has two parallel, strip-shaped side parts 54, 55 and a base 56 that bridges them. The side parts 54, 55 and the base 56 have flat contact surfaces on the inside for guiding the toothed rack 28.

The side parts 54, 55 and base 56 delimit a channel 57.

A top base part 58 has a greater wall thickness than a bottom base part 59 of the base 56. The top and bottom base part 58, 59 are connected to each other by a ramp 60 so that there is a smooth transition between the outer sides.

A longitudinal slot 61 extends in the middle of the base 56. The longitudinal slot 61 extends over the entire top base part 57 and terminates shortly before the bottom end of the bottom base part 59.

In the region of the top base part 58, a top slot section 62 of the longitudinal slot 61 is covered on the side by the head section 44.

A bottom slot section 63 of the longitudinal slot 61 extends in the bottom base part 59 and is wider than the first and second strip-shaped sections 48, 50 and the bend 49 which are arranged within, or respectively slightly before the slot section 63. Accordingly, a gap is on both sides of the first and second strip-shaped section, 48, 50 as well as the bend 49 and the bottom slot section 63.

The head section 44 is overmolded within the top base part at the edge by the plastic of the first cover part 42. On the side facing away from the toothed rack 28, the width of the edge-side edging of plastic is smaller than on the side of the head section 44 facing the toothed rack 28, wherein the edge-side edging defines the top slot section 62. Notches 45, 46 are anchored in the top base part 58. This fixes the second cover part 43 to the first cover part 42.

The sections of the second cover part 43 below the head section 44 are not overmolded and therefore are elastically extendable relative to the first cover part 42. For this purpose, the tapering 47, or respectively the first strip-shaped section 48, extend out of the ramp 60.

On the outside, the head section is bridged by webs 64 to 67 that extend perpendicular to the head section 44.

A coupling element 68 in the form of a pin extends from the web 65 and is injection molded as a single part with the first cover part 42.

In the outside, the first cover part 42 has a recess 69 that extends from the bottom slot section 63 to the side edge of the side part 54. The connecting section 51 extends to the side through this recess 69 so that the leaf spring 53 runs at a short distance from the first cover part 42.

The first cover part 42 has a catching edge 70 on the bottom end. This is formed on the bottom end of the bottom base part 59. At that location, the bottom base part 59 has a maximum wall thickness of 5 mm, and preferably 4 mm or less.

The outer side surface of the bottom base part 59 is a holding surface 71 for the pawl 39. The bottom base part has a bevel 72 at the bottom on the outer side. On the top end of the bevel 72, the bottom base part 59 has a wall thickness of 5 mm or more.

The catching edge 70 is interrupted by a short space 73 extending like a slot in the axial direction.

Strip-shaped wings 74, 75 project perpendicular from the outside of the side parts 54, 55.

The cover 41 is produced by inserting the second cover part 43 into an injection mold so that the bend 49 lies against a specific contact surface. Then the mold is closed, and the first cover part 42 is injection molded. The finished cover is distinguished in that the bend 49, pin 68 and catching edge 70 assume specific positions with adequate tolerances.

According to FIGS. 2 to 7, the toothed rack 28 extends through the channel 57 of the first cover part 42. The pawl 39 is threaded onto the leaf spring 53 of the second cover part 43 through a guide slot 76 on the bottom end. The cover 41 is movably guided in the housing 2 along the wings 74, 75 in the longitudinal direction.

Figure 9:
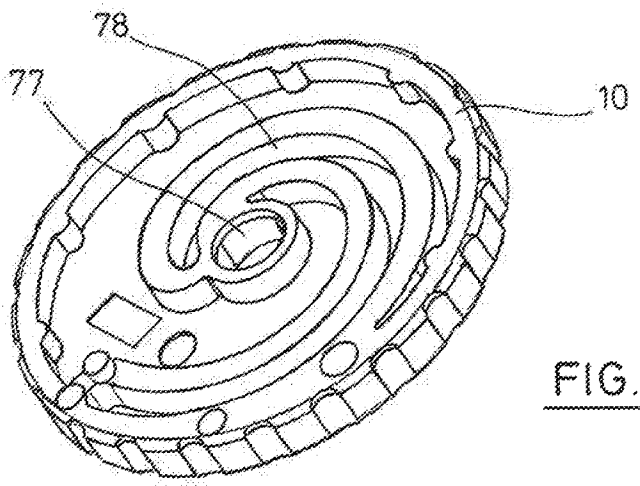
FIG. 9 shows the selection wheel in a view from below.

By rotating the selection wheel 10, the cover 41 can be displaced in the longitudinal direction. For this purpose, the selection wheel 10 according to FIG. 9 has a central bearing hole 77 and a spiral guide curve 78. The selection wheel 10 is rotatably mounted by the bearing hole 77 on a shaft on the housing 2, and the pin 68 of the cover 41 engages in the guide curve 78. Consequently, when the selection wheel 10 is rotated, the cover 41 is displaced along its guide in the housing 2.

The selection wheel 10 is assigned another sensor 79 that detects the rotary position of the selection wheel 10.

Figure 5:
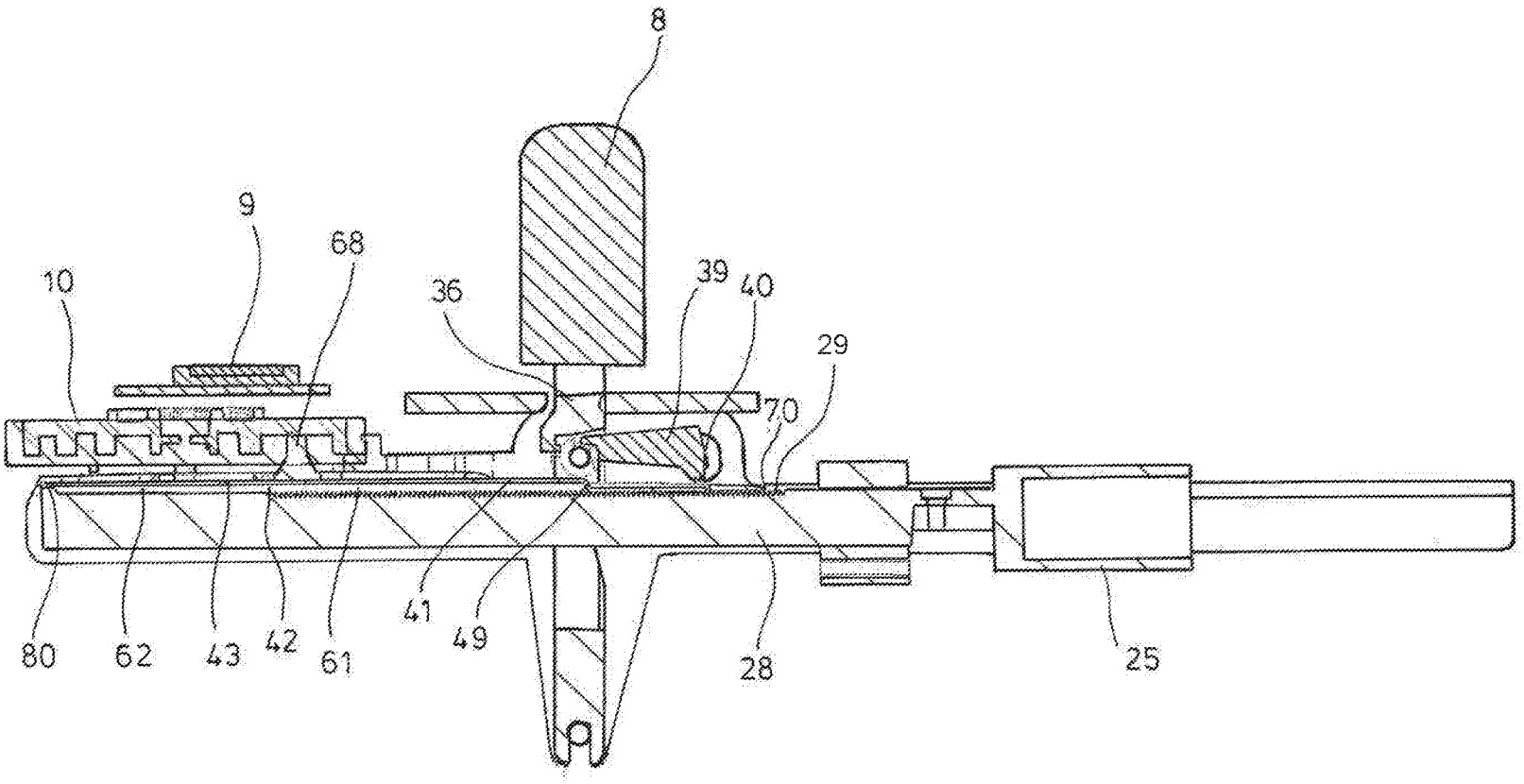
FIG. 5 shows the same arrangement in a longitudinal section.
Figure 6:
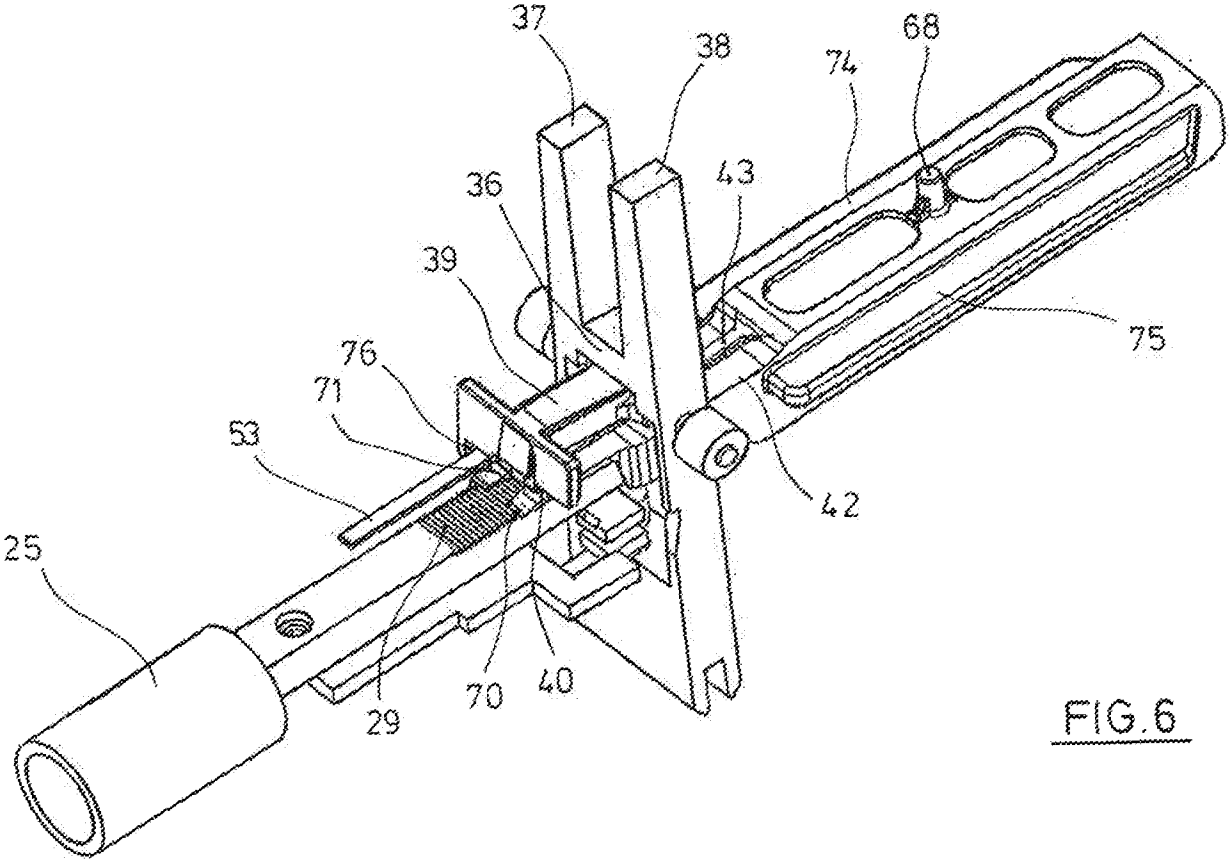
FIG. 6 shows the toothed rack with an actuation element, pawl and cover of the same pipette in another enlarged perspective view.

According to FIG. 5, a cam 80 is permanently molded onto the top end of the toothed rack 28 at a specific position.

When the toothed rack 28 is displaced downward, the cam 80 is moved through the longitudinal slot 61 in the cover 41, and extends out of the top slot section 62 into the bottom slot section 63. Finally, the cam 80 contacts the projecting bend 49 and presses it forward together with the leaf spring 53 (upward in FIG. 6). The pawl 39 guided on the leaf spring 53 is thereby lifted out of the teeth 29 and a remaining travel block is realized.

In addition to the toothed rack 28, a transmission element 81 is arranged in the pipette housing to control reverse travel. The transmission element 81 has a strip-shaped transmission section 82 that is guided and displaceable parallel to the toothed rack 28 in the housing 2 of the pipette.

The strip-shaped transmission section 82 has a bottom transmission element end 83 that is located in the displacement region of a bottom stop 84 projecting from the side of the toothed rack 28 when the transmission element 82 is displaced downward.

Two control arms 85, 86 are connected to the top end of the strip-shaped transmission section 82 which are arranged parallel to each other in a plane perpendicular to the plane of the drawing.

The transmission element 81 is displaceable such that the top ends of the control arms 85, 86 reach the displacement region of beveled stop edges on the legs 37, 38 (see FIG. 2).

The transmission element 81 and the components interacting therewith are preferably designed as described in European application 120 02 849.3-2113 and U.S. Ser. No. 13/867,800, the content of which is hereby incorporated in the present application.

Furthermore, a printed circuit board 87 with electronics 88 is arranged in the upper half of the housing 2. An electrical voltage supply in the form of at least one battery 89 (such as a button cell) or a rechargeable battery 89 is also located there. The electronics 88 with the ring sensor 22 is wired to the other sensor 79 for detecting the rotary position of the selection wheel 10 and the display 9. Furthermore, the electronics 88 are connected to the battery 89.

The electronics 88 determine the respective syringe size from the measurement signals supplied by the ring sensor 22, and the respective increment from the setting of the selection wheel 10. From this, they calculate the set dispensing volume and present it on the display 9.

When using the pipette 1, first a syringe 3 with a syringe size selected by the user is releasably connected to the pipette 1 by inserting it with the first fastening section 16 in the receptacle 20, and with the second fastening section 19 in the receptacle 24, so that the flange 17 is gripped by the first grip levers 23, and the fastening section 19 is gripped by the second grip levers 27. This situation is shown in FIG. 2.

The ring sensor 22 senses the code on the flange 17 of the syringe 3. With the signals provided by the ring sensor 22, the electronics 88 discern that a syringe 3 has been inserted and turn on the display 9. With the signals provided by the ring sensor 22 and by the other sensor 79, the electronics 88 determine the set dispensing volume and present it on the display 9. The user may change the setting of the dispensing volume using the selection wheel 10, and the changed metering volume is shown on the display 9.

To draw liquid through the hole 14 in the syringe 3, the drawing lever 5 is pressed upward out of the position in FIG. 2.

At the end of the drawing movement, the bottom stop 84 entrains the transmission element 81.

Before the set metering volume can be discharged step-by-step, reverse travel must occur. This is done by actuating the control knob 8. In so doing, the legs 37, 38 contact the control arms 85, 86 and displace the transmission element 81 downward. The transmission element 81 entrains the toothed rack 28 by the bottom stop 84. With this reverse travel, the slack is removed from the system.

Figure 10:
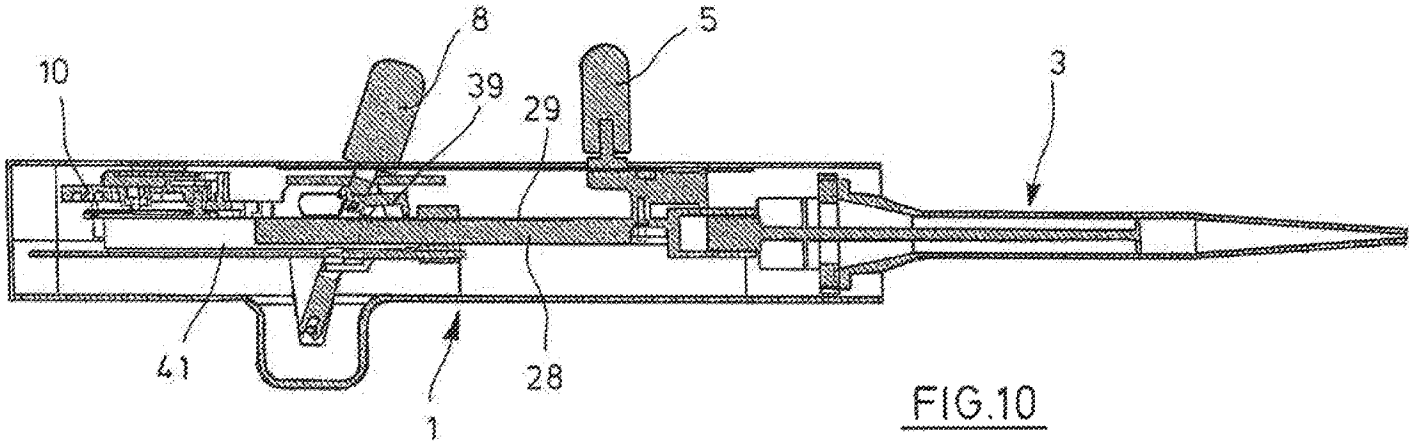
FIG. 10 shows the pipette while actuating the actuation element before the engagement of the pawl in the teeth in a longitudinal section.
Figure 11:
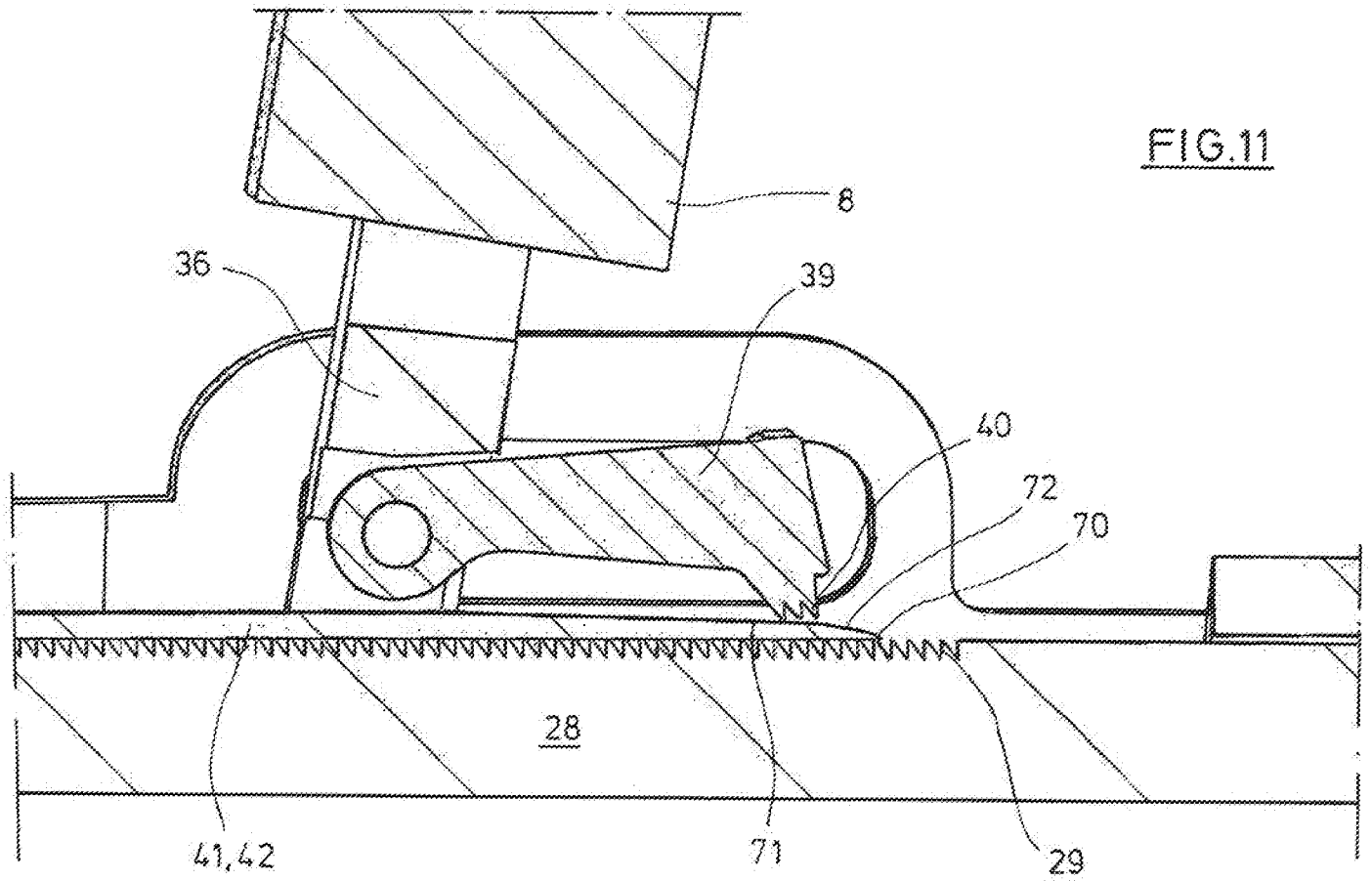
FIG. 11 shows the pipette in the same situation in an enlarged detailed view.

Then the drawn amount of liquid can be discharged in small steps by pressing the control knob 8 downward repeatedly against the effect of the spring apparatus. In so doing, the other spring apparatus presses the pawl 39 with the pawl teeth 40 against the holding surface 71 of the cover 41 until the pawl teeth 40 reach the bottom end of the holding surface 71. This situation is shown in FIGS. 10 and 11.

Figure 12:
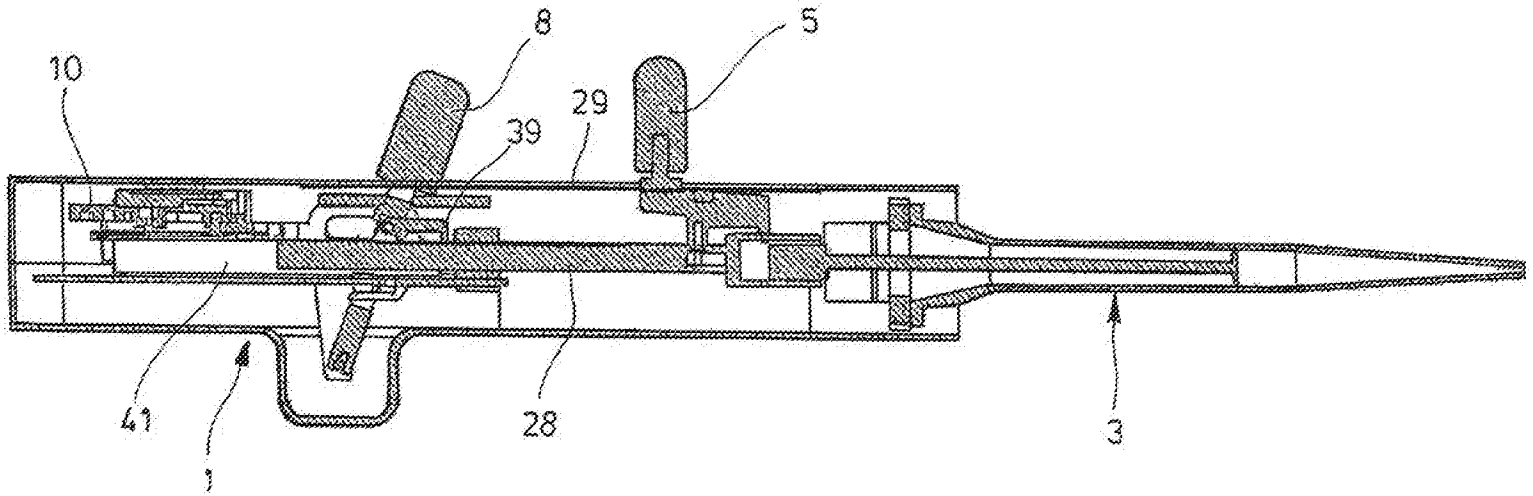
FIG. 12 shows a longitudinal section of the pipette when the pawl is optimally engaged in the teeth.
Figure 13:
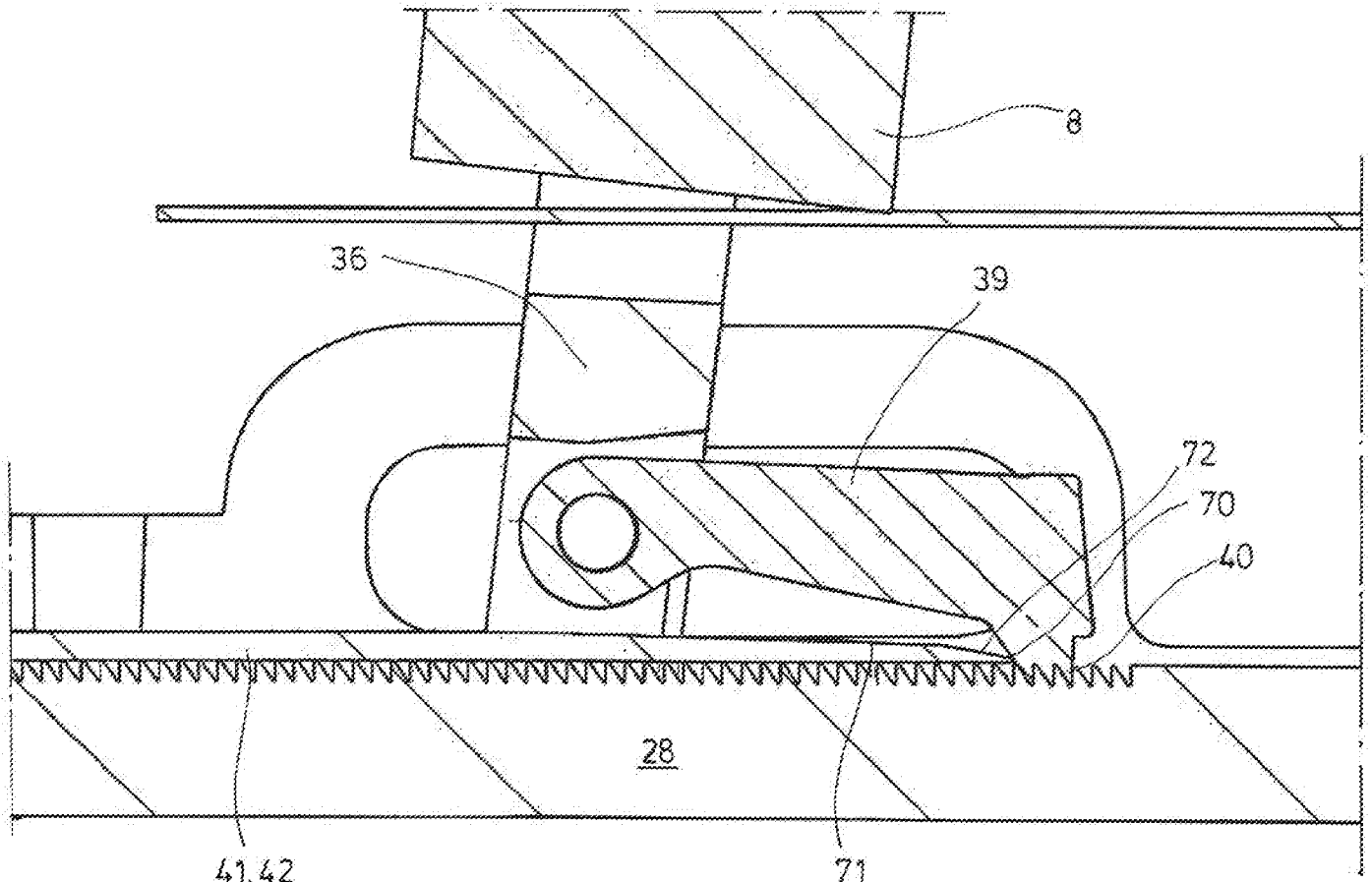
FIG. 13 shows the pipette in the same situation in an enlarged detailed view.

After passing the catching edge 70, the pawl 39 with the pawl teeth 40 falls into the teeth 29 of the toothed rack 28 and entrains the toothed rack 28 downward somewhat as the metering lever 36 continues to swing downward. This situation is shown in FIGS. 12 and 13. Given the precise position of the pin 68 and catching edge 70, the pawl teeth 40 fall precisely into the teeth 29. The displacement of the toothed rack 28 each time the metering lever 36 swings until a bottom stop is reached depends on a position of the cover 41 set by the selection wheel 10. After the control knob 8 is released, it is pressed upward by the spring apparatus, and another metering step can be executed.

Dispensing without refilling the syringe 3 can occur until the remaining amount of liquid in the syringe 3 is less than the set metered quantity. Then the remaining travel block ensures that the pawl teeth 40 can no longer fall into the teeth 29 in that the cam 80 actuates the leaf spring 53 which swings the pawl 39 away from the toothed rack 28.

Given the precise position of the cam 80 on the toothed rack 28, the pawl 39 is held by engaging in the toothed rack 28 when a complete metering step is no longer possible.

The remaining liquid in the syringe 3 can be discharged downward by displacing the drawing lever 5. Then the syringe 3 can be disconnected from the pipette 1. To do this, the user actuates the first grip levers 23 which act by means of projections on the inside on the second grip levers 27 as described in EP 0 656 229 B1 and U.S. Pat. No. 5,620,660.

Preferably, instead of grip levers 23, 27 that can be manually actuated directly, a pipette according to the invention has first and second means, for releasably holding the syringe, which are designed as described in EP 2 033 712 A1 and US 2009/139351 A1, the content of which is hereby incorporated in the present application. With the pipette according to the aforementioned documents, the syringe is disconnected from the pipette after being drained by an additional actuation of the metering lever. For this purpose, the pipette has a gearing that is controlled by the metering lever and acts on the first and second means for holding the syringe to disconnect the syringe from the pipette. According to an embodiment of this pipette, the first and second means for releasably holding are designed as the grip levers that are integrated in the housing and cannot be directly actuated from the outside.

According to FIGS. 12 and 13, the pawl 39 optimally falls into the teeth, i.e., each pawl tooth 40 engages precisely in one trough between two teeth of the teeth 29.

Figure 14:
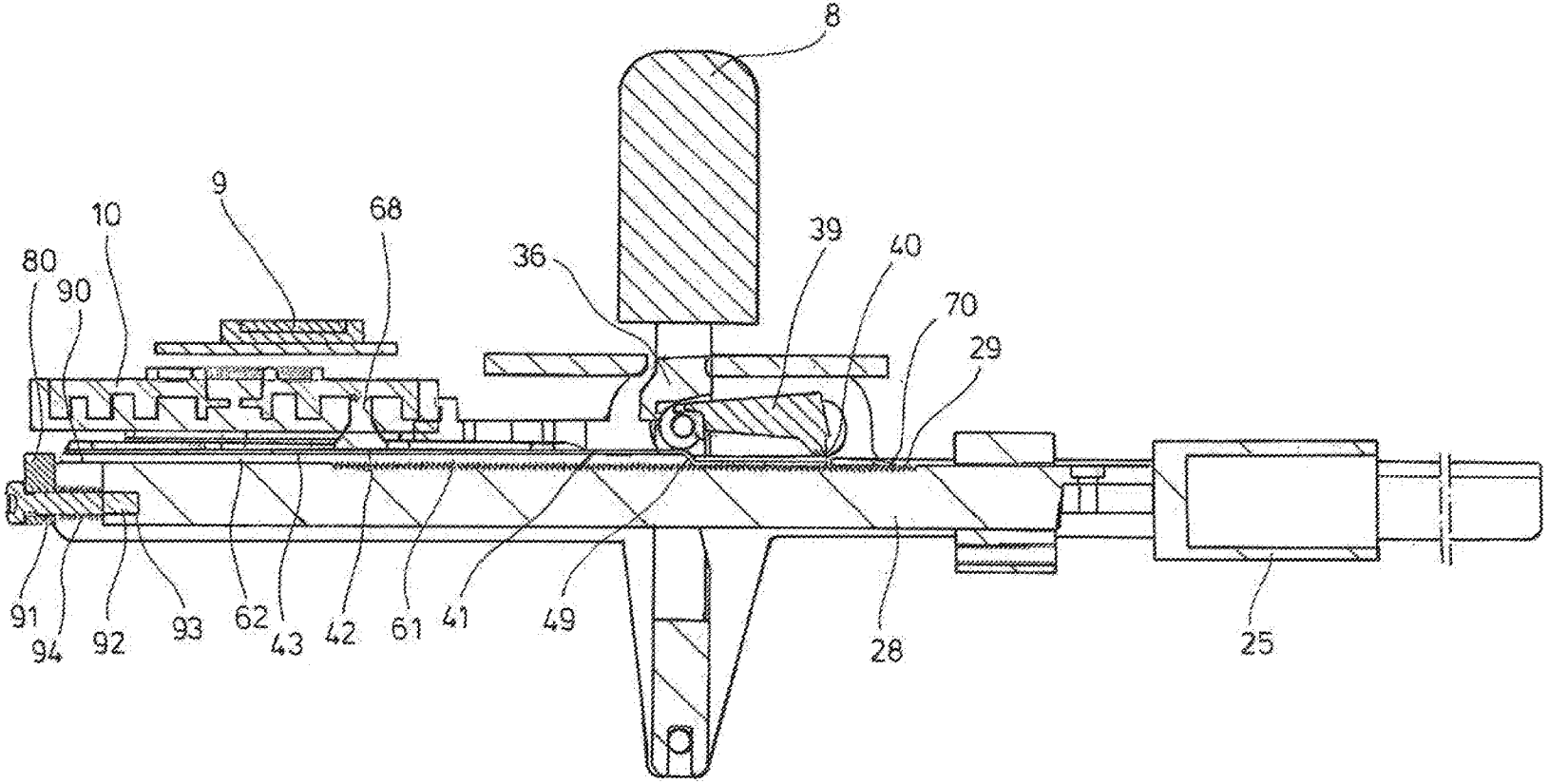
FIG. 14 shows an alternative toothed rack in a top frame part with the actuation element, pawl and cover in a longitudinal section.

FIG. 14 shows a pipette with an alternatively designed toothed rack 28.

With this toothed rack 28, the cam 80 projects to the outside out of an additional longitudinal slot 90 in the toothed rack 28. The cam 80 has an axial hole 91 under the additional longitudinal slot 90. An adjustment screw 92 is screwed through the axial hole 91 into an adjustment thread 93 on the top end of the toothed rack 28. A helical spring 94 is guided on the adjustment screw 92, and one end abuts the screw head of the adjustment screw 92, and the other end abuts the top end of the toothed rack 28 in order to hold the cam 80 against the screw head.

By turning the adjustment screw 92, the position of the cam 80 can be changed in the longitudinal direction of the toothed rack 28. This makes it possible to adjust the remaining travel block should this be necessary for whatever reason.

REFERENCE NUMBER LIST

1 Pipette
2 Housing
3 Syringe
4 Slot
5 Drawing lever
6 Slot
7 Slot
8 Control knob
9 Display
10 Selection wheel
11 Cylinder
12 Plunger
13 Conical section
14 Hole
15 Cylindrical section
16 First fastening section
17 Flange
18 Plunger rod
19 Second fastening section
20 First receptacle
21 First opening
22 Ring sensor
23 First grip lever
24 Second receptacle
25 Receiving body
26 Second opening
27 Second grip lever
28 Toothed rack
29 Teeth
30 Drawing lever holder
31 Drawing lever support
32 Slide plate
33 Post
34 Pivot bearing
35 Bulge
36 Metering lever
37 Leg
38 Leg
39 Pawl
40 Pawl tooth
41 Cover
42 First cover part
43 Second cover part
44 Head section
45 Notch
46 Notch
47 Tapering
48 First strip-shaped section
49 Bend
50 Second strip-shaped section
51 Strip-shaped connecting section
52 Deflection
53 Leaf spring
54 Side part
55 Side part
56 Base
57 Channel
58 Top base part
59 Bottom base part
60 Ramp
61 Longitudinal slot
62 Top slot section
63 Bottom slot section
64 Web
65 Web
66 Web
67 Web
68 Coupling element
69 Recess
70 Catching edge
71 Holding surface
72 Bevel
73 Space
74 Wings
75 Wings
76 Guide slot
77 Bearing hole
78 Guide curve
79 Additional sensor
80 Cam
81 Transmission element
82 Transmission section
83 Bottom transmission element end
84 Bottom stop
85 Control arm
86 Control arm
87 Printed circuit board
88 Electronics
89 Rechargeable battery
90 Additional longitudinal slot
91 Axial hole
92 Adjustment screw
93 Adjustment thread
94 Screw fields

The invention claimed is:

1. A pipette for actuating a syringe, comprising:

a strip-shaped housing (2), a first receptacle (20) with a first opening (21) at the bottom end of the housing (2) for inserting a first fastening section (16) at the top edge of a cylinder (11) of the syringe (3), a receiving body with a second receptacle (24) and a second opening (26) at the bottom end in the housing (2) for inserting a second fastening section (19) on a plunger (12) of the syringe (3), a first holding mechanism for releasably holding (23) the first fastening section (16) in the first receptacle (20), a second holding mechanism for releasably holding (27) the second fastening section (19) in the second receptacle (24), a first displacing mechanism for displacing (5) the receiving body (25) in the housing (2) away from the first receptacle (20), a second displacing mechanism for displacing (28, 36, 39) the receiving body (25) toward the first receptacle (20) in steps by an increment corresponding to the liquid volume to be ejected by the syringe (3) in the steps, an actuation element (36) which can be actuated outside of the housing (2) for executing individual steps, a toothed rack (28) with teeth (29) arranged in the housing (2) and connected to the receiving body (25), a pawl (39) pivotably mounted in the housing (2) on the actuation element (36) which engages with the teeth (29) of the toothed rack (28) and entrains the toothed rack when the actuation element (36) is displaced downward, and disengages with the teeth (29) when the actuation element (36) is displaced upward, an adjustable adjusting element (10) for adjusting the increment of the steps that can be adjusted outside of the housing (2), a cover (41) displaceably arranged on the toothed rack (28) on the side of the pawl (29) with a holding surface (71) facing the pawl (39), for holding the pawl (39) from engaging in the teeth (29), and a catching edge (70) at the bottom end, below which the teeth (29) are exposed for engagement by the pawl (39), a coupling element (68) arranged on the cover (41) that is coupled to the adjusting element (10) to transfer an adjustment of the adjusting element (10) to the cover (41), wherein the cover has a first cover part (42) consisting of plastic that comprises the coupling element (68) and a longitudinal slot (61), and a second cover part (43), consisting of sheet metal held on a bottom cover part (42), that comprises a bend (49) arranged in the longitudinal slot (61) and an associated leaf spring (53), the catching edge (70) is formed on the first cover part (42), the toothed rack on the side facing the cover has a projecting cam (80) that contacts the bend (49) in the longitudinal slot (61) at the end of the displacement of the receiving body (25) toward the first receptacle (20), whereby the leaf spring (53) is deflected, and the pawl (39) is held by the leaf spring (53) from further engagement in the teeth (29) of the toothed rack (28), and with the exception of a section comprising at least the bend (49) and leaf spring (53), the second cover part (43) is overmolded by the plastic of the first cover part (42) in a specific position of the bend (49) with respect to the coupling element (68) which securely connects the first cover part (42) and second cover part (43) to each other.

2. The pipette according to claim 1, wherein a head section (44) of the second cover part (43) is overmolded by the plastic of the first cover part (42) adjacent to a top slot section (62) of the longitudinal slot (61) on the side facing the toothed rack (28) on the edge, and the head section (44) is connected at the bottom end to the bend (49) that is arranged in a bottom slot section (63) of the longitudinal slot (61), next to which the second cover part (43) is not overmolded with the plastic of the first cover part (42), so that the cam (80) in the longitudinal slot (61) can slide along the head section (44) before it contacts the bend (49).

3. The pipette according to claim 2, wherein the second cover part (43) has a first strip-shaped section (48) that is connected to the bottom end of the head section (44) and is connected at the bottom end to the bend (49), and is arranged in the bottom slot section (63).

4. The pipette according to claim 2, wherein the second cover part (43) has a second strip-shaped section (50) connected to the bottom end of the bend (49) that is arranged in the bottom slot section (63) and on which the cam (80) can slide after passing the bend (49).

5. The pipette according to claim 1, wherein a connecting section (51) is connected to a longitudinal side edge of the first or second strip-shaped section (48, 50), extends through a recess (69) in the top side of the first cover part (42) to the longitudinal side edge of the first cover part (42), and is connected to the downwardly extending leaf spring (53) across a deflection (52) parallel to the longitudinal side of the first cover part (42).

6. The pipette according to claim 1, wherein the second cover part (43) is produced as a single part from sheet metal.

7. The pipette according to claim 1, wherein the second cover part (43) is covered by webs (64-67) of the first cover part (42) extending transversely to the toothed rack (28) on the side of the first cover part (42) facing away from the toothed rack (28).

8. The pipette according to claim 7, wherein a web (65) bears the coupling element (68).

9. The pipette according to claim 1, wherein the bottom end of the first cover part (42) has the catching edge (70).

10. The pipette according to claim 9, wherein the first cover part (42) has a wall thickness that gradually decreases toward the bottom end.

11. The pipette according to claim 9, wherein the first cover part (42) has a bevel (72) toward the bottom end on the side facing away from the toothed rack (28).

12. The pipette according to claim 1, wherein the first cover part (42) at the engagement edge has a maximum wall thickness of 0.5 mm and preferably 0.2 to 0.4 mm.

13. The pipette according to claim 1, wherein the first cover part (42) on the side facing the toothed rack (28) has a flat contact surface against which the toothed rack (28) can rest and in which the longitudinal slot (61) is arranged.

14. The pipette according to claim 1, wherein the first cover part (42) has the shape of an elongated hollow body with two parallel, strip-shaped side parts (54, 55) and a base (56) that delimits a channel (57), wherein the longitudinal slot (61) is formed in the base (56), and the second cover part (43) in the base (56) is overmolded by plastic from the first cover part (42).

15. The pipette according to claim 1, wherein the first cover part (42) has laterally projecting wings (74, 75) on the two longitudinal sides.

16. The pipette according to claim 1, wherein the toothed rack (28) is injection molded as a single part from plastic with the cam (80).

17. The pipette according to claim 1, wherein the cam (80) is arranged on the toothed rack (28) so as to be adjustable in an axial direction.

* * * * *